US007360263B2

(12) United States Patent
McCraw

(10) Patent No.: US 7,360,263 B2
(45) Date of Patent: Apr. 22, 2008

(54) BEDDING FOUNDATION SUPPORT MODULE

(75) Inventor: Kevin N. McCraw, Burnsville, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 129 days.

(21) Appl. No.: 11/345,176

(22) Filed: Feb. 1, 2006

(65) Prior Publication Data

US 2007/0174961 A1 Aug. 2, 2007

(51) Int. Cl.
*A47C 23/04* (2006.01)
*F16F 3/00* (2006.01)

(52) U.S. Cl. ..... 5/247; 5/255; 5/719; 267/103

(58) Field of Classification Search ..... 5/247, 5/255, 260, 264.1, 265–267, 719, 716; 267/103–107, 267/95, 144, 165
See application file for complete search history.

(56) References Cited

U.S. PATENT DOCUMENTS

| | | | |
|---|---|---|---|
| 1,528,125 | A | 3/1925 | Morse |
| 2,201,997 | A | 5/1940 | Freund |
| 2,415,765 | A | 2/1947 | Schmidt |
| 2,560,842 | A | 7/1951 | Blumensaadt et al. |
| 2,859,802 | A | 11/1958 | Asaro |
| 3,080,579 | A | 3/1963 | Gordon |
| 3,083,001 | A | 3/1963 | Makowski et al. |
| 3,286,281 | A | 11/1966 | Sominski |
| 3,288,458 | A | 11/1966 | Gutzman |
| 3,391,412 | A | 7/1968 | Bronstein, Jr. et al. |
| 3,546,723 | A | 12/1970 | Ciampa et al. |
| 3,660,854 | A | 5/1972 | Garceau |
| 3,662,411 | A | 5/1972 | Garceau |
| 3,725,965 | A | 4/1973 | Smith et al. |
| 3,766,578 | A | 10/1973 | Toupal |
| 3,777,322 | A | 12/1973 | Larkin |
| 3,803,689 | A | 4/1974 | Baginski |
| 3,825,960 | A | 7/1974 | Inman et al. |
| 3,907,266 | A | 9/1975 | Sano et al. |
| 3,916,463 | A | 11/1975 | Higgins |
| 4,000,531 | A | 1/1977 | Inman |
| 4,068,329 | A | 1/1978 | Gross et al. |
| 4,069,525 | A | 1/1978 | Valoff |
| 4,101,993 | A | 7/1978 | Yates et al. |
| 4,251,892 | A | 2/1981 | Hancock |
| 4,339,834 | A | 7/1982 | Mizelle |
| 4,377,279 | A | 3/1983 | Schulz, Jr. et al. |
| 4,398,705 | A | 8/1983 | Mizelle |
| 4,452,438 | A | 6/1984 | Hancock et al. |
| 4,470,584 | A | 9/1984 | Mizelle |
| 4,489,450 | A | 12/1984 | Miller |
| 4,559,654 | A | 12/1985 | Mizelle |

(Continued)

*Primary Examiner*—Robert G. Santos
(74) *Attorney, Agent, or Firm*—Marshall, Gerstein & Borun LLP

(57) ABSTRACT

A support module for use in a bedding foundation to support a support surface above a bedding foundation base, the support module being of an independent wire form configured to define a top portion, a bottom portion, and four predominantly straight support legs, wherein the support legs are skewed with respect to each other, such that each respective support leg is not parallel to any of the other support legs. The top of each support leg is bent to be oriented into a common first plane to form the top portion, which may be connected to a wire grid assembly to form a nestable bedding foundation.

21 Claims, 5 Drawing Sheets

U.S. PATENT DOCUMENTS 4,577,841 A 3/1986 Hagemeister
4,595,180 A 6/1986 Hagemeister
4,595,181 A 6/1986 Hagemeister
4,620,336 A 11/1986 Miller
4,654,905 A 4/1987 Miller
4,666,136 A 5/1987 Hagemeister
4,675,927 A 6/1987 Mizelle
4,684,111 A 8/1987 Hagemeister
4,685,162 A 8/1987 Higgins et al.
4,685,659 A 8/1987 Hagemeister
4,703,527 A 11/1987 Mizelle
4,704,752 A 11/1987 Yates et al.
4,721,290 A 1/1988 Hagemeister
4,729,550 A 3/1988 Hagemeister
4,730,357 A 3/1988 Wells
4,730,358 A 3/1988 Zapletal
4,736,933 A 4/1988 Hagemeister
4,739,977 A 4/1988 Dabney
4,760,616 A 8/1988 Hiatt et al.
4,766,625 A 8/1988 Yates et al.
4,770,397 A 9/1988 Schulz, Jr.
4,771,995 A 9/1988 Wells et al.
4,776,572 A 10/1988 Surletta et al.
4,778,157 A 10/1988 Thomas
4,779,293 A 10/1988 Dabney et al.
4,805,883 A 2/1989 Kitchen
4,838,528 A 6/1989 Hagemeister
4,862,531 A 9/1989 Wells
4,862,532 A 9/1989 Wells et al.
4,867,424 A 9/1989 Dabney
4,891,853 A 1/1990 Dabney
4,896,386 A 1/1990 Ogle et al.
4,903,949 A 2/1990 Schulz, Jr.
4,921,228 A 5/1990 Lowe
4,932,535 A 6/1990 Dabney
4,995,125 A 2/1991 Dennison
5,005,809 A 4/1991 Harmon
5,052,064 A 10/1991 Hagemeister et al.
5,054,751 A 10/1991 Brown
5,142,716 A 9/1992 Ogle et al.
5,152,509 A 10/1992 Wells et al.
5,165,667 A 11/1992 Dabney
5,176,367 A 1/1993 Rodgers et al.
5,178,372 A 1/1993 Rodgers et al.
5,188,344 A 2/1993 Dabney
5,197,155 A 3/1993 Ogle et al.
5,231,712 A 8/1993 Edwards et al.
5,246,210 A 9/1993 Dabney et al.
5,346,188 A 9/1994 Rodgers et al.
5,346,190 A 9/1994 Dabney
5,361,434 A 11/1994 Hagemeister et al.
5,369,822 A 12/1994 Dennison
5,370,374 A 12/1994 Rodgers et al.
5,395,097 A 3/1995 Dabney et al.
5,401,007 A 3/1995 Dabney et al.
5,438,716 A 8/1995 Dabney
5,497,979 A 3/1996 Schulz, Jr. et al.
5,551,104 A 9/1996 Hartline
5,558,315 A 9/1996 Constantinescu et al.
5,562,274 A 10/1996 Kitchen et al.
5,622,357 A 4/1997 Schulz, Jr. et al.
5,704,595 A 1/1998 Kitchen et al.
5,720,471 A 2/1998 Constantinescu et al.
5,778,466 A 7/1998 Price
5,964,453 A * 10/1999 McCraw ..... 267/103
5,967,499 A 10/1999 McCraw et al.
6,134,729 A 10/2000 Quintile et al.
6,192,538 B1 2/2001 Fogel
6,272,700 B1 8/2001 Wickstrom
6,406,009 B1 6/2002 Constantinescu et al.
6,419,212 B1 7/2002 Arnold et al.
6,481,033 B2 11/2002 Fogel
6,484,339 B2 11/2002 Mossbeck et al.
6,578,213 B2 * 6/2003 Dabney ..... 5/247
6,601,249 B2 8/2003 Arnold et al.
6,651,276 B2 * 11/2003 McCraw et al. ..... 5/246
7,237,282 B2 * 7/2007 Beck et al. ..... 5/247
2003/0028963 A1 * 2/2003 McCraw et al. ..... 5/246
2007/0174961 A1 * 8/2007 McCraw ..... 5/247
2007/0180614 A1 * 8/2007 McCraw ..... 5/247

* cited by examiner

BEDDING FOUNDATION SUPPORT MODULE

BACKGROUND OF THE INVENTION

1. Field of the Invention

The present invention generally relates to bedding foundations, and more particularly to support modules for use in nestably stackable wire bedding foundations.

2. Discussion of the Prior Art

It has become more common for mattress sets to include an upper spring mattress and a lower semi-rigid bedding foundation, instead of a lower box spring mattress. The completed semi-rigid bedding foundation is typically manufactured in stages, by two or more different manufacturers. The first manufacturer makes a wire bedding foundation assembly having a plurality of support modules or other support structures connected to a wire grid assembly that represents a support surface. The second manufacturer makes a wooden slatted base to which the wire assembly is mounted. The second manufacturer or a third manufacturer then finishes the process of making the completed bedding foundation by attaching the wire assembly to a wooden slatted base, and then typically adding padding and a fabric cover.

To date, there are numerous versions of such semi-rigid bedding foundations, and it has been found to be particularly efficient for warehousing and shipping purposes if the wire assemblies are made to be nestably stackable. That is to say that when one wire bedding foundation assembly is stacked atop another like wire assembly, portions of the upper wire assembly fit at least partially within the lower wire assembly, such that the height of the two wire assemblies when stacked is less than the total of the individual heights of the two wire assemblies added together.

The bedding industry has developed various nestably stackable configurations, which either utilize individual support modules connected to an upper wire grid, such as is disclosed in U.S. Pat. No. 5,967,499, or use some form of elongated bent wires that run the length of a bedding foundation to create a nestably stackable foundation, such as disclosed in U.S. Pat. No. 5,052,064. However, these types of bedding foundations exhibit a disadvantageous inherent tendency to have support legs, running from the upper wire grid to the base of the wire assembly, which are parallel to or perpendicular to the sides or ends of the wire grid assembly. Such orientation of the support legs tends to have good performance in resisting either lateral or longitudinal forces on the upper surface of the bedding foundation, but does not perform favorably in regard to forces from multiple directions in addition to their basic function of vertically supporting the upper surface of the bedding foundation.

An object of the present invention is to provide an additional novel and nonobvious type of support module for use in a nestably stackable bedding foundation which permits efficient manufacture, storage and shipping of bedding foundations of the semi-rigid wire type. A further object of the invention is to provide a support module that when connected to a wire grid is better equipped to resist forces from multiple directions. Another object of the present invention is to provide at least three mounting points for connection of each support module to an upper wire grid assembly. Still another object of the present invention is to provide nestably stackable bedding foundation assemblies having support modules that permit easy stacking and removal of one bedding foundation with respect to another like bedding foundation. Another object of the invention is to provide a bedding foundation assembly that may be easily attached to a base structure.

The present invention addresses shortcomings in prior art bedding foundation assemblies, while providing the above mentioned desirable features.

SUMMARY OF THE INVENTION

The purpose and advantages of the present invention will be set forth in and apparent from the description and drawings that follow, as well as will be learned by practice of the invention.

The present invention is generally embodied in a support module for use in a bedding foundation of the relatively rigid or semi-rigid wire type. The support modules are nestably stackable individually, as well as when assembled in bedding foundations.

In a first aspect of the invention, a support module for use in a bedding foundation to support a wire grid assembly above a bedding foundation base has an independent wire form configured to define a top portion, a bottom portion, and four predominantly straight support legs, wherein the support legs are skewed with respect to each other, such that each respective support leg is not parallel to any of the other support legs, and wherein the top portion further has a first pair of upper portions of two of the support legs being relatively close together and joined in a first wire segment and a second respective pair of upper portions of the other two support legs being relatively further spaced apart than the first pair, and being spaced apart from the first pair with the first wire segment and the upper portions of the other two support legs all being located in a substantially horizontal first plane.

In a further aspect of the invention, a nestable bedding foundation has a wire grid assembly and a plurality of support modules, each support module being an independent wire form configured to define a top portion, a bottom portion, and four predominantly straight support legs interconnecting the top portion to the bottom portion, the top portion being connected to the wire grid assembly. The top portion further has a first pair of upper portions of two of the support legs being relatively close together and joined in a first wire segment and a second respective pair of upper portions of the other two support legs being relatively further spaced apart than the first pair, and being spaced apart from the first pair with the first wire segment and the upper portions of the other two support legs all being located in a substantially horizontal first plane. The bottom portion further has a first predominantly straight wire segment located in a substantially horizontal second plane and being formed from a lower portion of each of two of the support legs, and a second predominantly straight wire segment located in a substantially horizontal third plane and being formed from a lower portion of each of the respective other two of the support legs. Also, the four predominantly straight support legs are skewed with respect to each other, such that each support leg is not parallel to any of the other respective support legs.

In a further aspect of the invention, a nestable bedding foundation is provided wherein all of the support modules are arranged so that a first bedding foundation is nestably stackable on top of a second identical bedding foundation, with the bottom portions of the support modules of the first bedding foundation being received through the wire grid assembly and within the respective support modules of the second identical bedding foundation.

Thus, the present invention provides an alternative to the prior art bedding foundations and support modules therefor. The present invention also simplifies the assembly and handling of bedding foundations constructed with the inventive support modules. The new assemblies improve the ability to handle force inputs to an upper wire grid assembly in multiple directions, while providing for greater ease in nestably stacking and unstacking the bedding foundation assemblies.

It is to be understood that both the foregoing general description and the following detailed description are exemplary and provided for purposes of explanation only, and are not restrictive of the invention as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
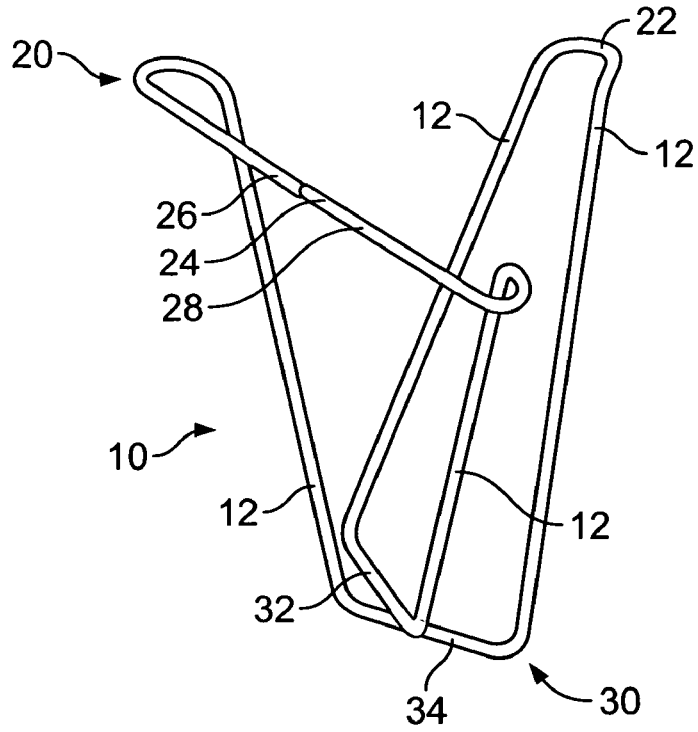
FIG. 1 is a perspective view of a preferred embodiment of a support module of the present invention.
Figure 2:
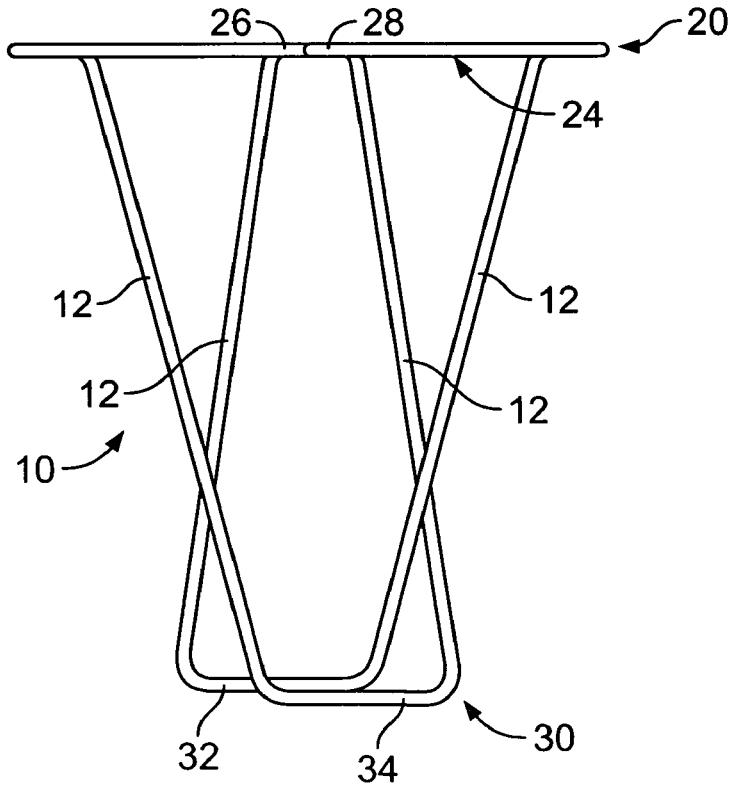
FIG. 2 is a side view of the support module of FIG. 1.

It should be understood that the drawings are not to scale and provide examples involving support modules and bedding foundation assemblies within the scope and spirit of the present invention. While considerable mechanical details of a support module and bedding assembly, including other plan and section views of the particular components, have been omitted, such details are considered well within the comprehension of those skilled in the art in light of the present disclosure. It also should be understood that the present invention is not limited to the preferred embodiments illustrated.

DETAILED DESCRIPTION OF THE PREFERRED EMBODIMENTS

Referring generally to FIGS. 1-5, it will be appreciated that the support modules and nestable bedding foundation of the present invention generally may be embodied within numerous configurations.

Referring to the preferred embodiments in FIGS. 1-5, a wire support module 10 is shown as an independent three-dimensional wire form. Support module 10 is configured for use in a bedding foundation 50 to support a wire grid assembly 60 above a bedding foundation base 80.

Support module 10 is configured to define a top portion 20, a bottom portion 30, and four predominantly straight support legs 12. It will be appreciated that support legs 12 are skewed with respect to each other, such that each respective support leg is not parallel to any of the other support legs. As best seen in the side view in FIG. 2, support legs 12 of support module 10 provide a cross-bracing support structure.

Top portion 20 includes two unequally spaced pairs of upper portions of support legs. For instance, as best seen in FIG. 1, a first pair of upper portions of two support legs 12 are relatively close together and are connected by a first wire segment 22. A second pair of upper portions of the other two support legs 12 are relatively further spaced apart and include respective ends 26 and 28 of the independent wire form. It is preferred, for enhanced rigidity, that as shown in FIGS. 1-5, wire ends 26 and 28 be butt welded together, forming a relatively longer second wire segment 24. In this configuration, first wire segment 22 is spaced from relatively longer second wire segment 24, with both segments being located in a common substantially horizontal first plane. However, it will be appreciated that, as seen in FIG. 3A, wire ends 26 and 28 need not extend long enough to touch or to be butt welded together, and indeed could alternatively simply be much shorter segments that are welded to the overlying wires of grid assembly 60.

Bottom portion 30 includes a first predominantly straight wire segment 32 located in a substantially horizontal second plane and is formed from a lower portion of each of two of the support legs 12. A second predominantly straight wire segment 34 is located in a substantially horizontal third plane and is formed from a lower portion of each of the respective other two of the support legs. Wire segments 32 and 34 preferably are connected, such as by welding, at their intersection.

A support surface in the form of a wire grid 60 of bedding foundation 50 is a subassembly of wires connected together within a fairly common plane. Wire grid 60 preferably includes a rectangular-shaped border wire 62, including a pair of parallel side portions 64 and perpendicular thereto, a pair of parallel end portions 66. Laterally spaced wires 68 run parallel to each other and to side portions 64 and are connected to end portions 66, while longitudinally spaced wires 70 run parallel to each other and to end portions 66 and are connected to side portions 64. The wire connections in wire grid 60 are preferably made by welding or may be made by other suitable means of connection.

Figure 3:
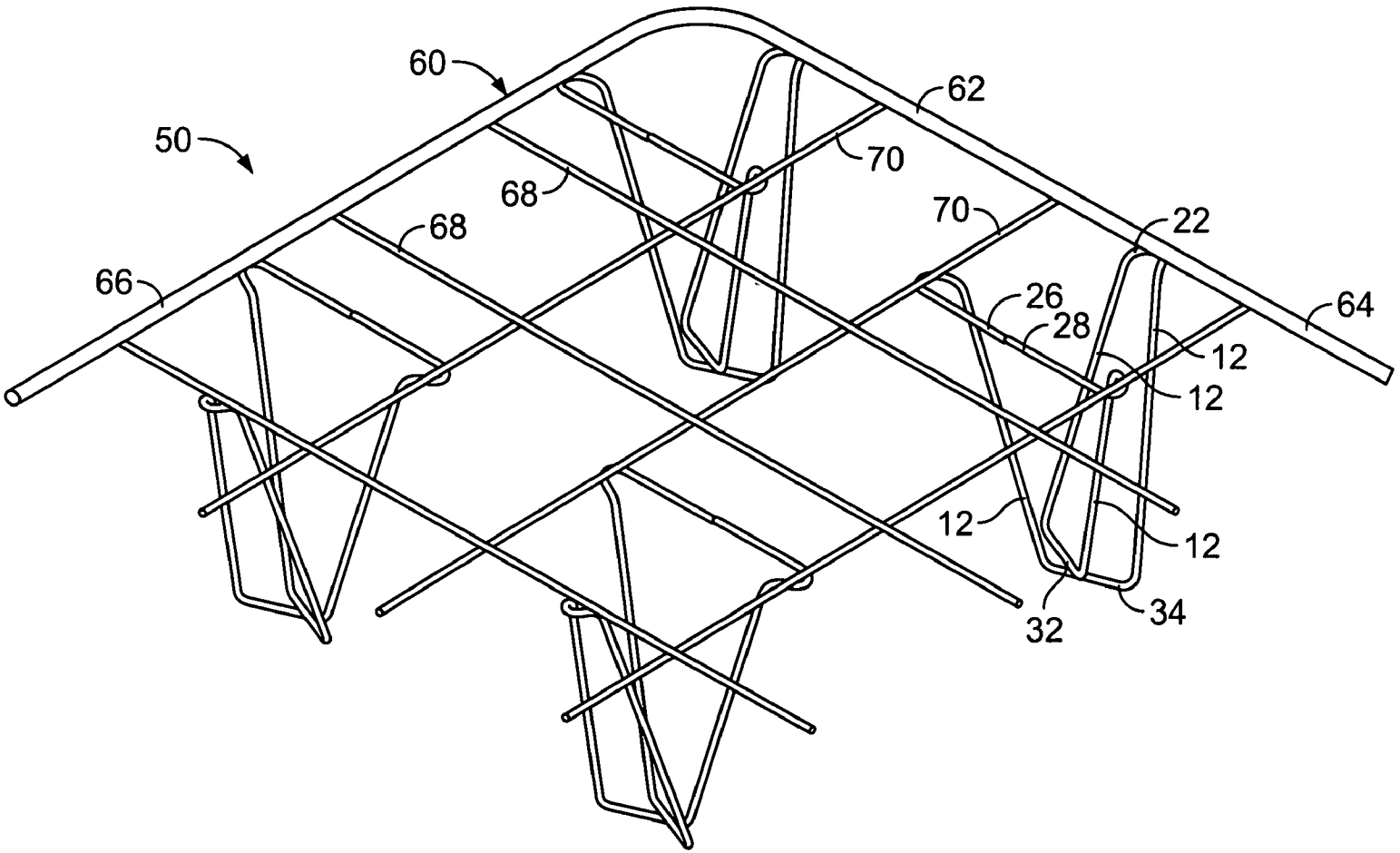
FIG. 3 is a perspective view of a portion of a bedding foundation showing support modules of FIG. 1 connected to a portion of a wire grid assembly and being located in two rows in a mirror image orientation with respect to each other.
Figure 3A:
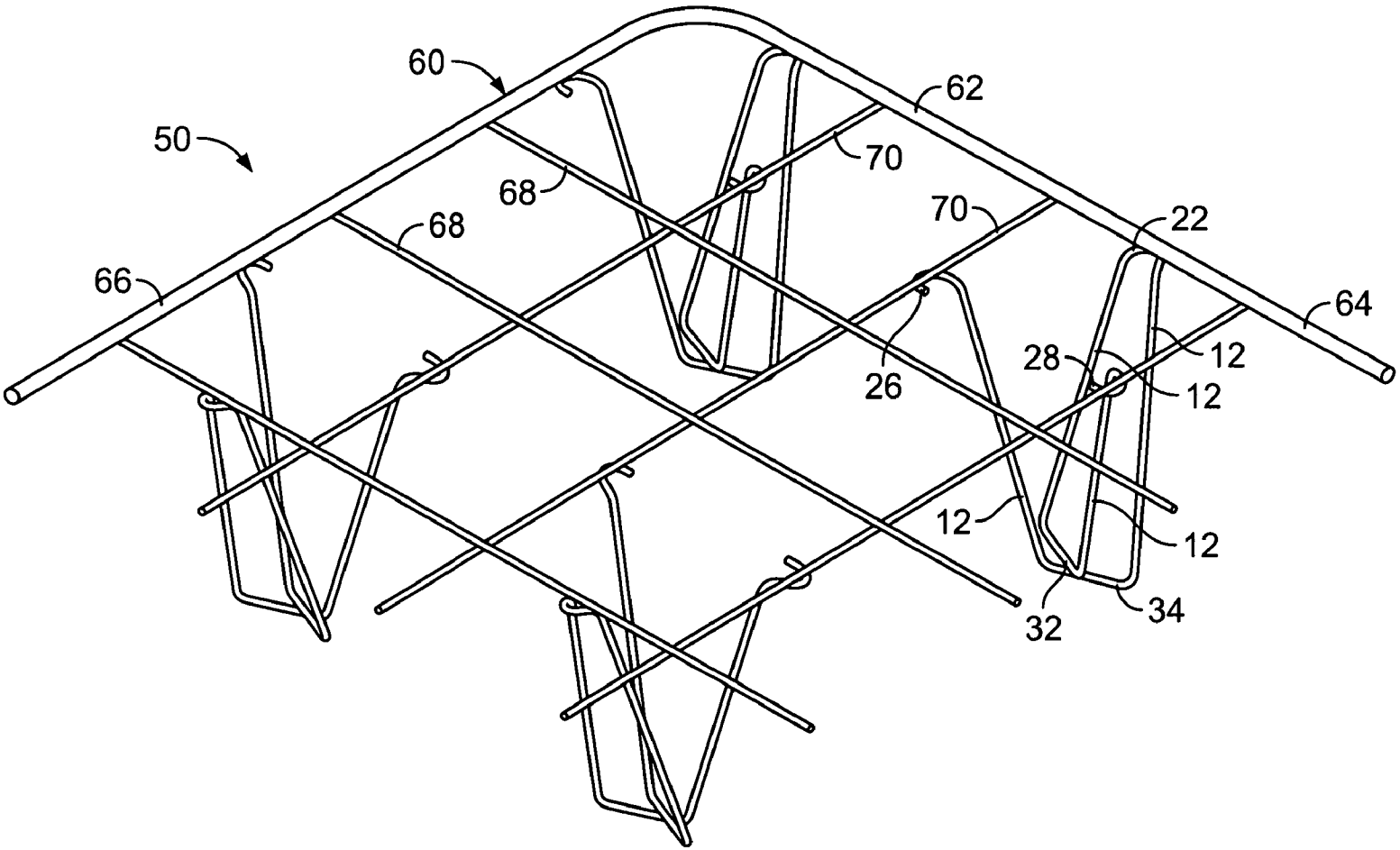
FIG. 3A is a perspective view similar to FIG. 3 but with an alternative support module construction.
Figure 4:
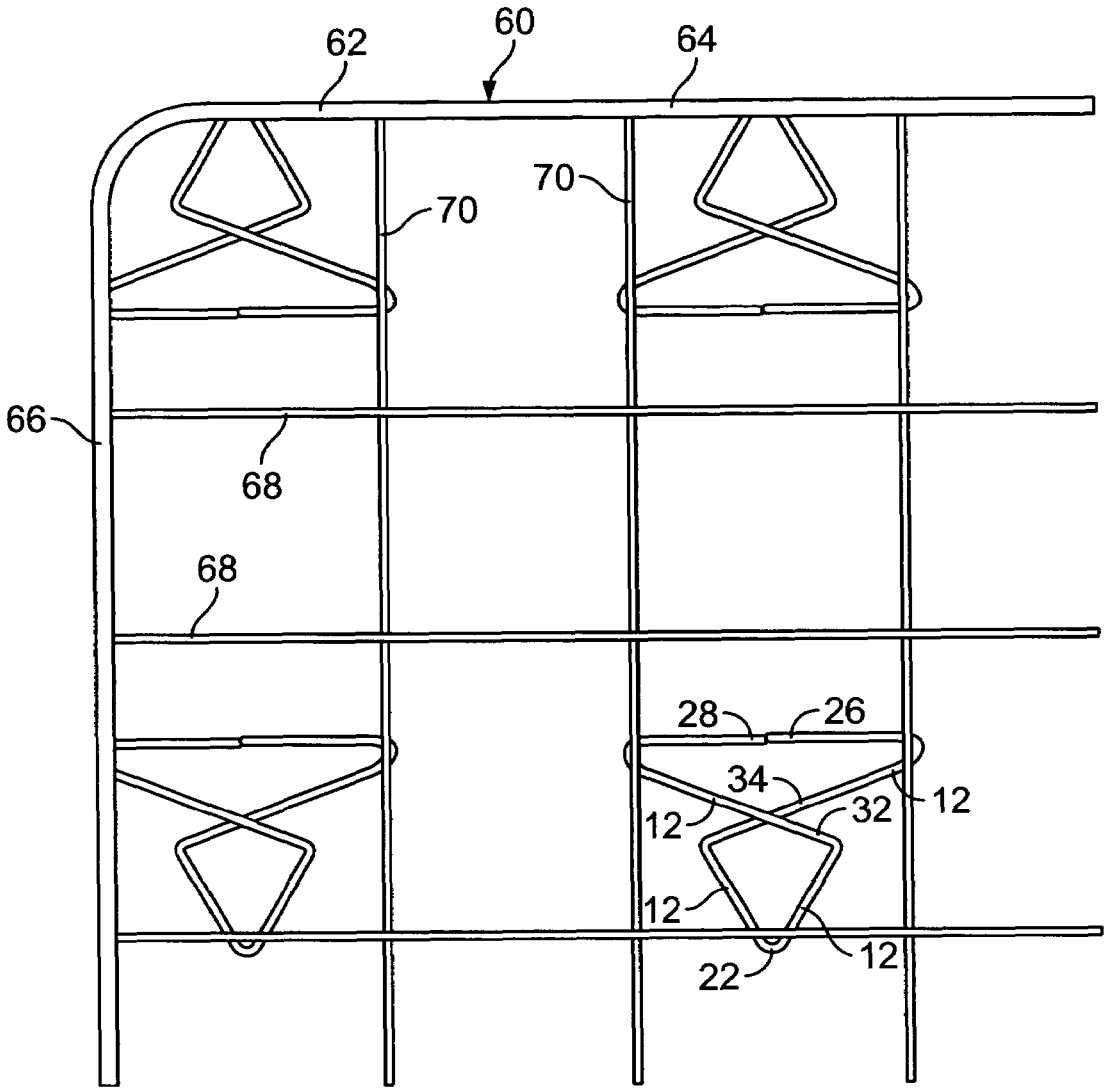
FIG. 4 is a top view of the portion of a bedding foundation shown in FIG. 3.

As best seen in FIGS. 3 and 4, the skewed orientation of support legs 12, and the cross-bracing nature of support legs 12, result in a bedding foundation 50 that is better able to resist forces from multiple directions. To add to this enhanced capability, as seen in FIGS. 3 and 4, support modules 10 may be placed in different rotational orientations with respect to each other. For instance, the two rows of support modules 10 are shown in a mirror image format with respect to each other. Placements in such a multi-directional pattern will result in less uniform load paths, and thereby still better ability to handle forces from multiple directions.

It will be appreciated by one of skill in the art that due to the inclined nature of support legs 12, despite the relatively narrow waist, wider bottom, and apparent crossing of the support legs, modules 10 are ideally suited for nestably stacking one within another. Indeed, when further connected to a wire grid 60 in locations that correspond with openings in wire grid 60, nestably stackable bedding foundation assemblies 50 are formed. Moreover, by having the terminal wire ends 26, 28 of each individual piece of wire from which each support module is formed face each other, wire ends 26, 28 are prevented from having a tendency to catch on a respective second bedding foundation assembly 50 when stacking or unstacking such assemblies.

Figure 5:
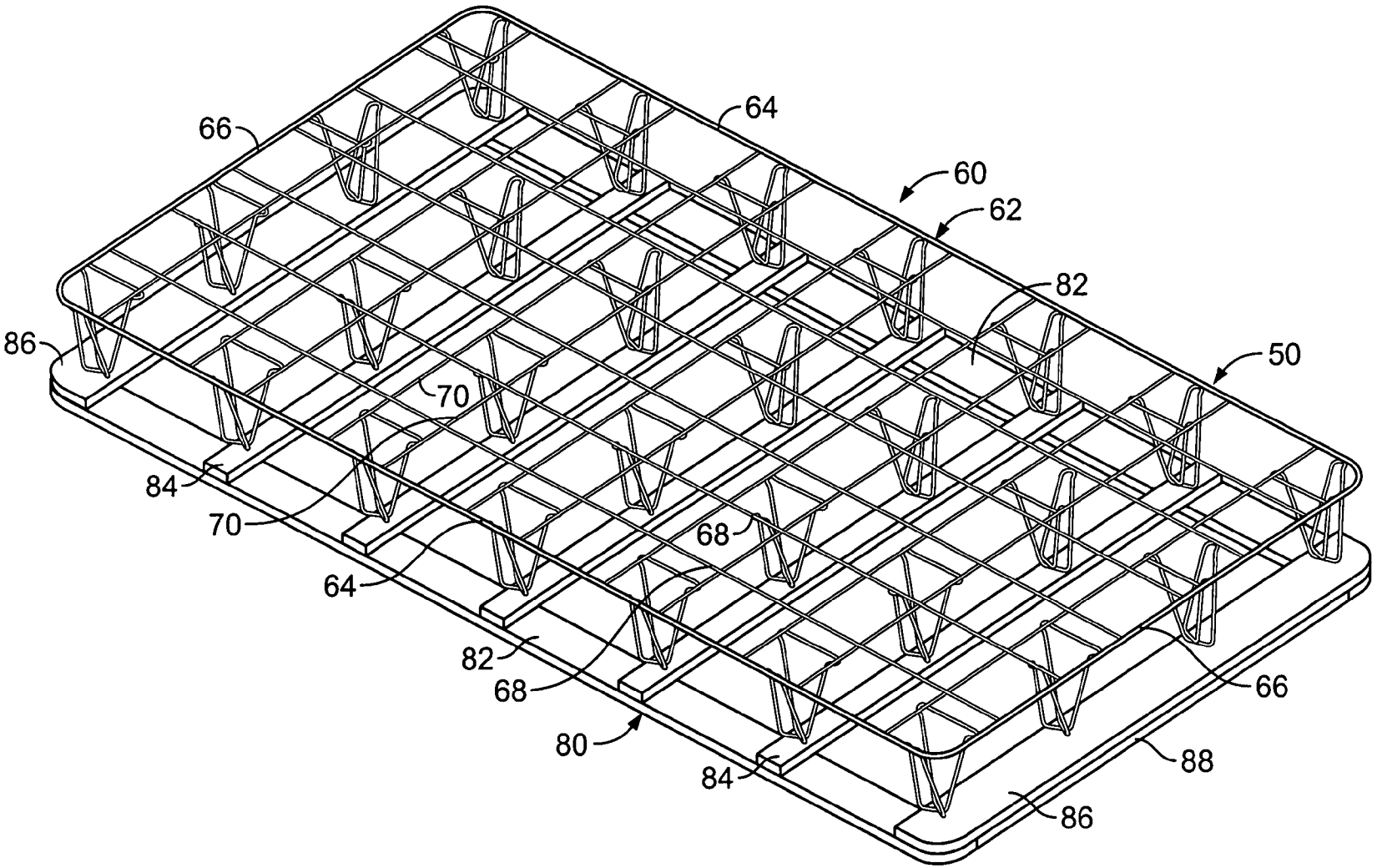
FIG. 5 is a perspective view of a bedding foundation having support modules of FIG. 1 being located in two pair of rows in mirror image orientation with respect to each other and with each module being connected to a wire grid assembly and a slatted base.

As shown in FIG. 5, bedding foundation 50 may be connected to a bedding foundation base 80. This operation is frequently done after shipping stacks of nestably stacked bedding foundations 50 to bedding manufacturers. In such instances, the bedding manufacturers typically complete an assembly by mounting a wire bedding foundation 50 to a wooden bedding foundation base 80, and then covering the assembly in padding and fabric.

Bedding foundation base 80 is shown, for example, in a simple formation of a slatted wooden frame having side slats 82, connected to overlying lateral slats 84, and overlying end slats 86 which are further connected to lower end slats 88. In this form, the various slats are typically joined by nailing or stapling, but may be joined in any suitable manner. Also, while shown in a relatively simple wooden format, for instance for a twin bed, base 80 may be constructed in other configurations, having more or less longitudinal and lateral slats, and be made with materials other than wood, as well as with other methods of joining components. In essence, base 80 ultimately is to be configured to accept the mounting of a plurality of modules 10 to the upper side of the overlying lateral slats 84 and end slats 86, such as by stapling to a wooden slat the bottom portion 30 of each module 10, at predominantly straight section 34 and/or at predominantly straight section 32.

It will be appreciated that support modules in accordance with the present invention may be provided in various configurations, and may be constructed with portions joined to each other or to other metal components such as by welding together the pieces of wire, or otherwise joining them. Any variety of suitable materials of construction, configurations, shapes and sizes for the components and methods of connecting the components may be utilized to meet the particular needs and requirements of an end user in constructing bedding foundations consistent with the present invention. It will be apparent to those skilled in the art that various modifications can be made in the design and construction of such support modules and bedding foundations without departing from the scope or spirit of the present invention, and that the claims are not limited to the preferred embodiments illustrated.

What is claimed is:

1. A support module for use in a bedding foundation to support a wire grid assembly above a bedding foundation base, the support module comprising an independent wire form configured to define a top portion, a bottom portion, and four predominantly straight support legs, wherein the support legs are skewed with respect to each other, such that each respective support leg is not parallel to any of the other support legs, and wherein the top portion further comprises a first pair of upper portions of two of the support legs being relatively close together and joined in a first wire segment and a second respective pair of upper portions of the other two support legs being relatively further spaced apart than the first pair, and being spaced apart from the first pair with the first wire segment and the upper portions of the other two support legs all being located in a substantially horizontal first plane.

2. A support module in accordance with claim 1, wherein each of the upper portions of the other two support legs further comprise an end of the independent wire form.

3. A support module in accordance with claim 2, wherein the two ends of the independent wire form face each other.

4. A support module in accordance with claim 3, wherein the two ends of the independent wire form are butt welded together to form a relatively longer second wire segment in the top portion.

5. A support module in accordance with claim 1, wherein a lower portion of each of two of the support legs is bent to form a portion of a predominantly straight wire segment that is oriented in a substantially horizontal second plane.

6. A support module in accordance with claim 5, wherein a lower portion of each of the respective other two of the support legs is bent to form a portion of a predominantly straight wire segment that is oriented in a substantially horizontal third plane.

7. A support module in accordance with claim 6, wherein the predominantly straight wire segment that is oriented in the substantially horizontal second plane and the predominantly straight wire segment that is oriented in the substantially horizontal third plane are located within the space delineated by the support legs.

8. A support module in accordance with claim 6, wherein the predominantly straight wire segment that is oriented in the substantially horizontal second plane is connected to the predominantly straight wire segment that is oriented in the substantially horizontal third plane.

9. A support module in accordance with claim 1, wherein the independent wire form of the support module consists of a single length of wire.

10. A support module in accordance with claim 1, wherein the respective support legs are disposed in independent directions from the top portion to the bottom portion in a manner in which from a side view at least two of the support legs appear to cross.

11. A nestable bedding foundation comprising a wire grid assembly and a plurality of support modules, each support module being an independent wire form configured to define a top portion, a bottom portion, and four predominantly straight support legs interconnecting the top portion to the bottom portion, the top portion being connected to the wire grid assembly; the top portion further comprising a first pair of upper portions of two of the support legs being relatively close together and joined in a first wire segment and a second respective pair of upper portions of the other two support legs being relatively further spaced apart than the first pair, and being spaced apart from the first pair with the first wire segment and the upper portions of the other two support legs all being located in a substantially horizontal first plane; the bottom portion further comprising a first predominantly straight wire segment located in a substantially horizontal second plane and being formed from a lower portion of each of two of the support legs, and a second predominantly straight wire segment located in a substantially horizontal third plane and being formed from a lower portion of each of the respective other two of the support legs; and the four predominantly straight support legs are skewed with respect to each other, such that each support leg is not parallel to any of the other respective support legs.

12. A nestable bedding foundation in accordance with claim 11, wherein the wire grid assembly further comprises a border wire connected to a plurality of longitudinally spaced substantially straight wires and to a plurality of laterally spaced substantially straight wires.

13. A nestable bedding foundation in accordance with claim 11, wherein the top portion of a support module is connected to the wire grid assembly.

14. A nestable bedding foundation in accordance with claim 11, wherein the top portion of a support module is welded to a border wire of the wire grid assembly.

15. A nestable bedding foundation in accordance with claim 11, wherein the top portion of a support module is welded to at least one of a laterally spaced wire of the wire grid assembly and to at least one of a longitudinally spaced wire of the wire grid assembly.

16. A nestable bedding foundation in accordance with claim 11, wherein at least one of the support modules consists of a single length of wire.

17. A nestable bedding foundation in accordance with claim 11, wherein each of the upper portions of the other two support legs further comprise an end of the independent wire form.

18. A nestable bedding foundation in accordance with claim 17, wherein the two ends of the independent wire form are butt welded together to form a relatively longer second wire segment in the top portion.

19. A nestable bedding foundation in accordance with claim 11, wherein all of the support modules are arranged so that a first bedding foundation is nestably stackable on top of a second identical bedding foundation, with the bottom portions of the support modules of the first bedding foundation being received through the wire grid assembly and within the respective support modules of the second identical bedding foundation.

20. A nestable bedding foundation in accordance with claim 11, wherein the bottom portion of at least one support module is secured to a slatted foundation base.

21. A nestable bedding foundation in accordance with claim 11, wherein the respective support legs of each support module are disposed in independent directions from the top portion to the bottom portion in a manner in which from a side view at least two of the support legs appear to cross.

* * * * *

UNITED STATES PATENT AND TRADEMARK OFFICE

CERTIFICATE OF CORRECTION

PATENT NO. : 7,360,263 B2
APPLICATION NO. : 11/345176
DATED : April 22, 2008
INVENTOR(S) : Kevin N. McCraw It is certified that error appears in the above-identified patent and that said Letters Patent is hereby corrected as shown below:

On the Title Page:

At field (*), add -- This patent is subject to a terminal disclaimer --.

Signed and Sealed this

Nineteenth Day of August, 2008

JON W. DUDAS
*Director of the United States Patent and Trademark Office*